US011245182B2

(12) United States Patent
Han et al.

(10) Patent No.: US 11,245,182 B2
(45) Date of Patent: Feb. 8, 2022

(54) ANTENNA ELEMENT

(71) Applicant: AAC Technologies Pte. Ltd., Singapore (SG)

(72) Inventors: Hongjuan Han, Shenzhen (CN); Yuehua Yue, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 16 days.

(21) Appl. No.: 16/995,840

(22) Filed: Aug. 18, 2020

(65) Prior Publication Data

US 2020/0411976 A1 Dec. 31, 2020

Related U.S. Application Data

(63) Continuation of application No. PCT/CN2019/094076, filed on Jun. 30, 2019.

(51) Int. Cl.

| | |
|---|---|
| ***H01Q 1/24*** | (2006.01) |
| ***H01Q 1/38*** | (2006.01) |
| ***H01Q 1/48*** | (2006.01) |
| ***H01Q 9/04*** | (2006.01) |

(52) U.S. Cl.

CPC ..... *H01Q 1/38* (2013.01); *H01Q 1/246* (2013.01); *H01Q 1/48* (2013.01); *H01Q 9/0407* (2013.01)

(58) Field of Classification Search

CPC ..... H01Q 1/24–48; H01Q 9/0407; H01Q 21/24–26

See application file for complete search history.

(56) References Cited

U.S. PATENT DOCUMENTS

| | | | | |
|---|---|---|---|---|
| 2017/0117634 | A1* | 4/2017 | Park | H01Q 9/285 |
| 2020/0106195 | A1* | 4/2020 | Fleancu | H01Q 1/246 |
| 2021/0175639 | A1* | 6/2021 | Wang | H01Q 1/38 |

* cited by examiner

*Primary Examiner* — Hasan Islam

(74) *Attorney, Agent, or Firm* — W&G Law Group

(57) ABSTRACT

The invention provides an antenna element having a feed unit, a first radiation unit and a second radiation unit, wherein the feed unit includes two differential feed circuits and four grounding ends. Each differential feed circuit includes an input end and two output ends. The first radiation unit includes a first radiation body. The second radiation unit includes four second radiation bodies and four grounding elements. According to the antenna element provided by the invention, through feeding of the first radiation body and the second radiation bodies in a coupled feeding manner, the number of solder joints can be reduced; and through arrangement of the second radiation bodies extending in a serpentine form, the profile height of the antenna element can be reduced and the requirements of customers on miniaturization of a base station are met.

8 Claims, 3 Drawing Sheets

ANTENNA ELEMENT

FIELD OF THE PRESENT DISCLOSURE

The invention relates to the field of antenna technologies, in particular to an antenna element.

DESCRIPTION OF RELATED ART

In order to meet the bandwidth requirements of an antenna, the height of a common antenna element of a base station is about ¼ of a working wavelength of the antenna in general. In order to meet broader bandwidth requirements, an existing antenna element is usually designed into a relatively large height. However, the antenna element is relatively high, cannot meet the requirements of customers on miniaturization of the base station and is low in market competitiveness.

SUMMARY OF THE INVENTION

A major object of the invention is to provide an antenna element with broader bandwidth and smaller size.

For achieving the object mentioned above, the invention provides an antenna element, comprising:

a feed unit comprising two differential feed circuits and four grounding ends; wherein each differential feed circuit comprises an input end and two output ends;

a first radiation unit comprising a first radiation body; and a second radiation unit comprising four second radiation bodies and four grounding elements, wherein the four grounding elements and the four second radiation bodies are separately arranged at intervals;

one end of each second radiation body is connected with one output end of one differential feed circuit and the other end extends in a serpentine form and is arranged apart from the first radiation body to perform coupled feeding on the first radiation body;

and one end of each grounding element is connected with the first radiation body and the other end is connected with one grounding end.

As an improvement, the feed unit further comprises a feed dielectric board; the differential feed circuits and the grounding ends are arranged on the feed dielectric board; one straight line in which two output ends of one differential feed circuit are positioned is perpendicular to the other straight line in which two output ends of the other differential feed circuit are positioned.

As an improvement, the first radiation unit further comprises a first dielectric plate; the first radiation body is fixed on the first dielectric plate; and a plurality of hollowed grooves arranged at intervals in the circumference direction are formed in the first radiation body.

As an improvement, an annular area, in which the hollowed grooves are formed, of the first radiation body is defined as a hollowed area; an area in which the hollowed grooves are not formed, in the middle of the annular area is a central area; and one end of each of the four grounding elements is connected with the central area.

As an improvement, four hollowed grooves are formed and are arranged at equal intervals in the circumference direction of the first radiation body; or eight hollowed grooves are formed and are arranged at equal intervals in the circumference direction of the first radiation body.

As an improvement, the second radiation unit further comprises two second dielectric plates vertically connected with the feed dielectric board; the two second dielectric plates are arranged in a cross form and are connected to form a connection part and an extension part extending towards four directions from the connection part; and one side surface of each extension part is provided with one second radiation body and one grounding element.

As an improvement, the two second dielectric plates are arranged in a cross form to form four quadrants; and one second radiation body is arranged in each quadrant.

As an improvement, one side of each second dielectric plate connected with the feed dielectric board is defined as a bottom part; one side of the second dielectric plate far away from the feed dielectric board is defined as a top part; and each second radiation body comprises a first extension part extending from the bottom part to the top part, a second extension part extending in a bent manner from one end of the first extension part far away from the bottom part to the bottom part, a third extension part extending in a bent manner from one end of the second extension part close to the bottom part to the top part, and a fourth extension part extending in a bent manner from one end of the third extension part far away from the bottom part to the bottom part.

According to the antenna element provided by the invention, through feeding of the first radiation body and the second radiation bodies in a coupled feeding manner, the number of solder joints can be reduced; and through arrangement of the second radiation bodies extending in a serpentine form, the profile height of the antenna element can be reduced and the requirements of customers on miniaturization of a base station are met.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

Figure 1:
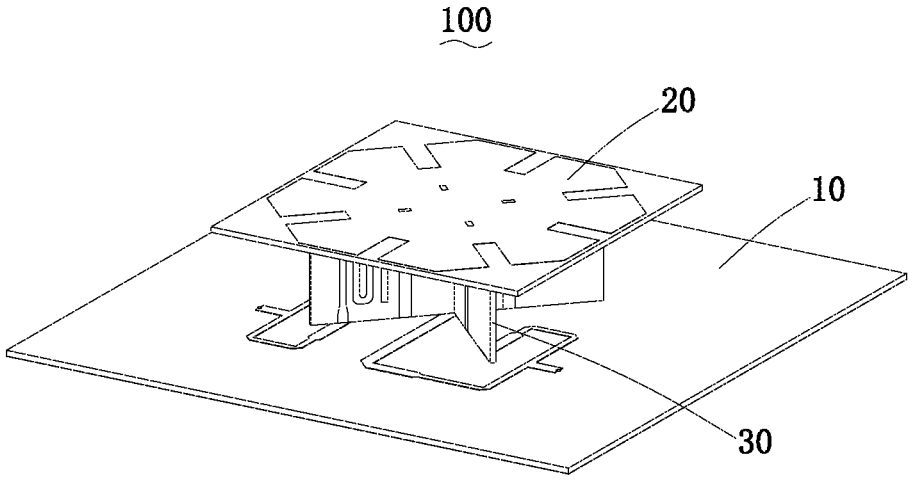
FIG. 1 is a frontal structural schematic view of an antenna element provided by an embodiment of the present invention.

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

It is to be noted that all directional indicators in the embodiments of the invention (for example, upper, lower, left, right, front, back, inner, outer, top, bottom and the like) are only used for explaining relative position relationships among parts in some special gesture (for example, shown in the drawings) and so on. If the special gesture changes, the directional indicators also change correspondingly.

It should also be noted that when an element is referred to as being "fixed" or "disposed" on another element, the element may be directly on the other element or there may be intervening elements at the same time. When an element is called "connected" to another element, it may be directly connected to the other element or there may be intervening elements at the same time.

Figure 2:
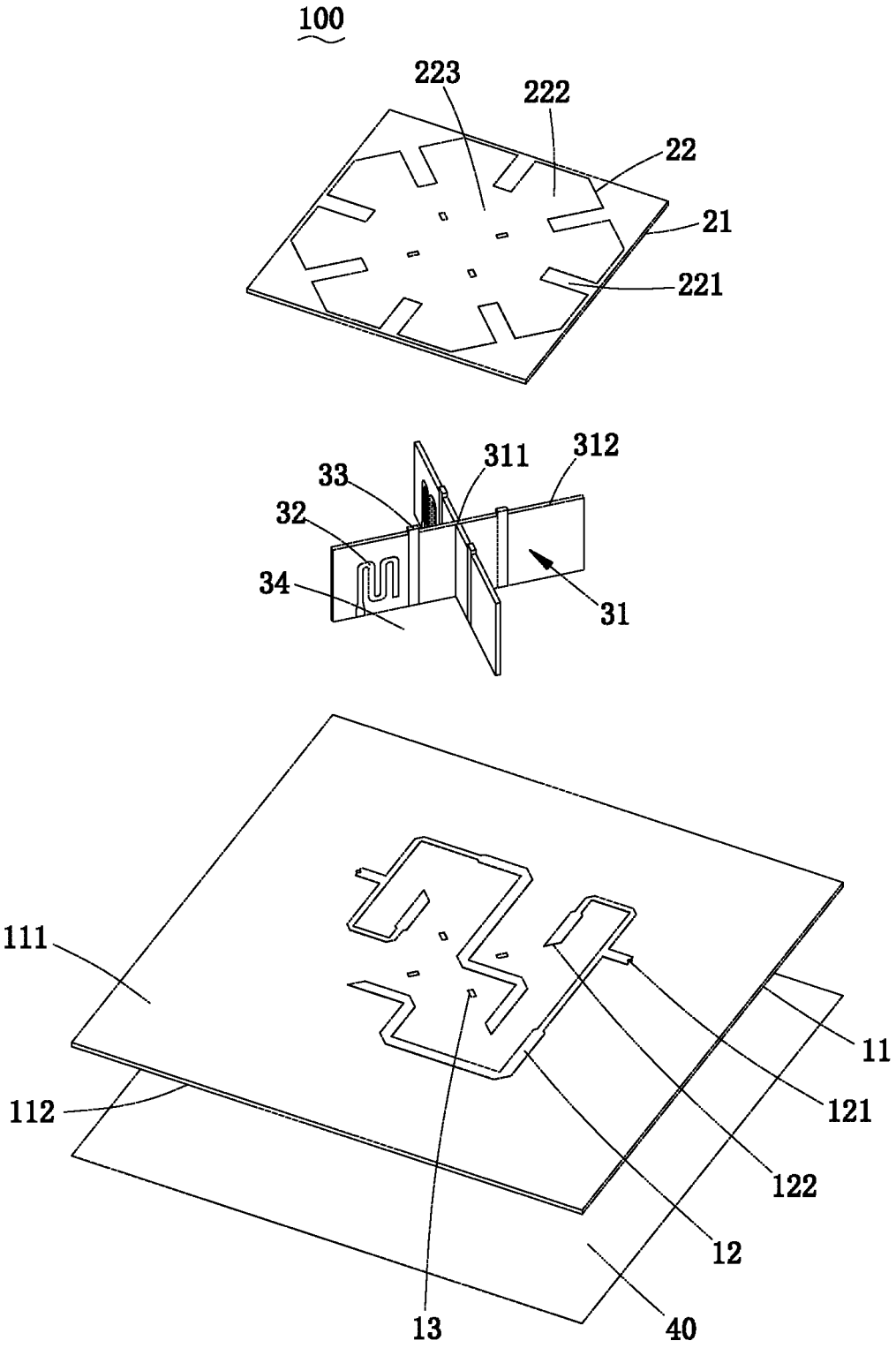
FIG. 2 is an exploded view of the antenna element in FIG. 1.
Figure 3:
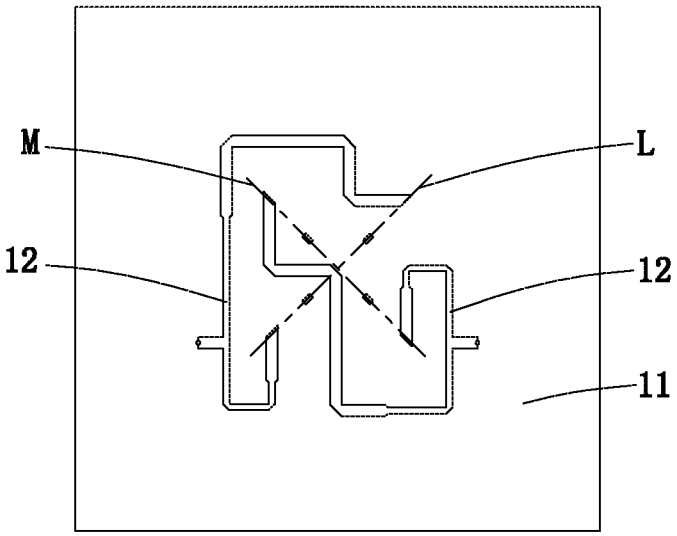
FIG. 3 is a top view of a feed unit provided by the embodiment of the invention.
Figure 4:
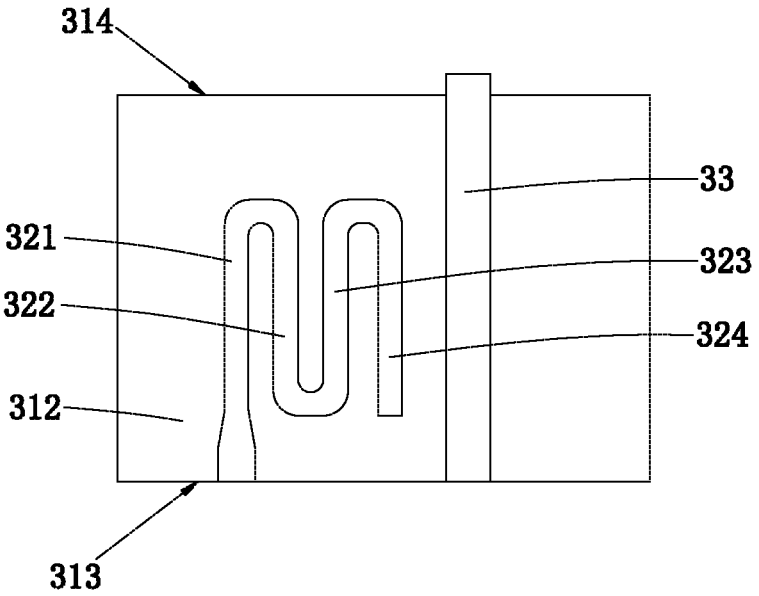
FIG. 4 is a layout schematic view of a second radiation unit provided by the embodiment of the invention on second dielectric plates.

Referring to FIGS. 1-4, an antenna element 100, provided by the embodiment of the invention, comprises a feed unit 10, a first radiation unit 20 and a second radiation unit 30. The feed unit 10 comprises a feed dielectric board 11, two differential feed circuits 12 and four grounding ends 13. The differential feed circuits 12 and the grounding end 13 are arranged on the feed dielectric board 11. Each differential feed circuit 12 comprises an input end 121 and two output ends 122. The first radiation unit 20 comprises a first dielectric plate 21 and a first radiation body 22. The first radiation body 22 is fixed on the first dielectric plate 21. The second radiation unit 30 comprises two second dielectric plates 31, four second radiation bodies 32 and four grounding elements 33 which are separately arranged apart from the second radiation bodies 32. The two second dielectric plates 31 both are vertically connected with the feed dielectric board 11. The two second dielectric plates 31 are arranged in a cross form. The two second dielectric plates 31 are connected to form a connection part 311 and an extension part 312 extending towards four directions from the connection part 311. One side surface of each extension part 312 is provided with one second radiation body 32 and one grounding element 33. One end of each second radiation body 32 is connected with one output end of one differential feed circuit 12 and the other end extends in a serpentine form and is arranged apart from the first radiation body 22 to perform coupled feeding on the first radiation body 22. One end of each grounding element 33 is connected with the first radiation body 22 and the other end is connected with one grounding end 13. When the antenna element 100 is used, each second radiation body 32 and the corresponding differential feed circuit 12 thereof form a linear polarization in one direction, and the whole antenna element 100 achieves orthogonal dual-polarization.

In the embodiment, through feeding of the first radiation body 22 and the second radiation bodies 32 in a coupled feeding manner, the number of solder joints can be reduced, and passive intermodulation (PIM) features of a system are improved. Through arrangement of the second radiation bodies 32 extending in a serpentine form, on one hand, the electrical lengths of the second radiation bodies 32 can be effectively prolonged, and on the other hand, the profile height of the antenna element 100 can be reduced, the requirements of customers on miniaturization of a base station are met and the market competitiveness is improved. Through feeding of the second radiation bodies 32 in a differential feeding manner, the polarization purity of the antenna element 100 is improved.

Preferably, the feed unit 10, the radiation unit 20 and the second radiation unit 30 all can be manufactured and formed by adopting a PCB process. The feed unit 10, the first radiation unit 20 and the second radiation unit 30 formed by the PCB manufacturing process are high in precision and good in product consistency, so that the performance of products is stable and assembly is facilitated. Preferably, Rogers4730G3 can be adopted as a material of the feed dielectric board 11, the dielectric plate 21 and the second dielectric plates 31.

As an improvement of the embodiment, one straight line L in which two output ends of one differential feed circuit 12 are positioned is perpendicular to the other straight line M in which two output ends of the other differential feed circuit 12 are positioned.

As an improvement of the embodiment, a plurality of hollowed grooves 221 arranged at intervals in the circumference direction are formed in the first radiation body 22. Specifically, each hollowed groove 221 extends from the edge of the first radiation body 22 to the center of the first radiation body 22. Through the arrangement of the hollowed grooves 221, the electrical length of the first radiation body 22 can be prolonged.

Preferably, four hollowed grooves 221 are formed, and the four hollowed grooves 221 are arranged at equal intervals in the circumference direction of the first radiation body 22. In other embodiments, eight hollowed grooves 221 are formed, and the eight hollowed grooves 221 are arranged at equal intervals in the circumference direction of the first radiation body 22.

As an improvement of the embodiment, an annular area, in which the hollowed grooves 221 are formed, of the first radiation body 22 is defined as a hollowed area 222; an area, in which the hollowed grooves 221 are not formed, in the middle of the annular area is a central area 223; and one end of each of the four grounding elements 13 is connected with the central area 223.

As an improvement of the embodiment, the two second dielectric plates 31 are arranged in a cross form to form four quadrants 34; and one second radiation body 32 is arranged in each quadrant 34.

As an improvement of the embodiment, one side, connected with the feed dielectric board 11, of each second dielectric plate 31 is defined as a bottom part 313; one side, far away from the feed dielectric board 11, of the second dielectric plate 31 is defined as a top part 314; and each second radiation body 32 comprises a first extension part 321 extending from the bottom part 313 to the top part 314, a second extension part 322 extending in a bent manner from one end, far away from the bottom part 313, of the first extension part 321 to the bottom part 313, a third extension part 323 extending in a bent manner from one end, close to the bottom part 313, of the second extension part 322 to the top part 314, and a fourth extension part 324 extending in a bent manner from one end, far away from the bottom part 313, of the third extension part 323 to the bottom part 313.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An antenna element, comprising:

a feed unit comprising two differential feed circuits and four grounding ends, wherein each differential feed circuit comprises an input end and two output ends;

a first radiation unit comprising a first radiation body; and a second radiation unit comprising four second radiation bodies and four grounding elements, wherein the four grounding elements and the four second radiation bodies are separately arranged at intervals;

one end of each second radiation body is connected with one output end of one of the two differential feed circuits and another end of each second radiation body extends in a serpentine form and is arranged apart from the first radiation body to perform coupled feeding on the first radiation body; and one end of each grounding element is connected with the first radiation body and another end of each grounding element is connected with a respective one of the four grounding ends.

2. The antenna element as described in claim 1, wherein the feed unit further comprises a feed dielectric board;

the two differential feed circuits and the grounding ends are arranged on the feed dielectric board;

a first straight line in which two out put ends of one of the two differential feed circuits are positioned is perpendicular to a second straight line in which two output ends of another of the two differential feed circuits are positioned.

3. The antenna element as described in claim 1, wherein the first radiation unit further comprises a first dielectric plate; the first radiation body is fixed on the first dielectric plate; and a plurality of hollowed grooves arranged at intervals in the circumference direction are formed in the first radiation body.

4. The antenna element as described in claim 3, wherein an annular area, in which the hollowed grooves are formed, of the first radiation body is defined as a hollowed area; an area in which the hollowed grooves are not formed, in the middle of the annular area is a central area; and one end of each of the four grounding elements is connected with the central area.

5. The antenna element as described in claim 3, wherein four hollowed grooves are formed and are arranged at equal intervals in the circumference direction of the first radiation body; or eight hollowed grooves are formed and are arranged at equal intervals in the circumference direction of the first radiation body.

6. The antenna element as described in claim 2, wherein the second radiation unit further comprises two second dielectric plates vertically connected with the feed dielectric board; the two second dielectric plates are arranged in a cross form and are connected to form a connection part and an extension part extending towards four directions from the connection part; and one side surface of each extension part is provided with one second radiation body and one grounding element.

7. The antenna element as described in claim 6, wherein the two second dielectric plates are arranged in a cross form to form four quadrants; and one second radiation body is arranged in each quadrant.

8. The antenna element as described in claim 6, wherein one side of each second dielectric plate connected with the feed dielectric board is defined as a bottom part;

one side of the second dielectric plate far away from the feed dielectric board is defined as a top part; and each second radiation body comprises a first extension part extending from the bottom part toward the top part, a second extension part extending in a bent manner from one end of the first extension part far away from the bottom part toward the bottom part, a third extension part extending in a bent manner from one end of the second extension part close to the bottom part toward the top part, and a fourth extension part extending in a bent manner from one end of the third extension part far away from the bottom part toward the bottom part.

* * * * *